US007827066B1

(12) United States Patent
Guy et al.

(10) Patent No.: US 7,827,066 B1
(45) Date of Patent: Nov. 2, 2010

(54) METHOD OF DISTRIBUTING

(75) Inventors: Tami L. Guy, Menlo Park, CA (US); Jeffrey L. Briggs, Loomis, CA (US); Anne L. Mason, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1951 days.

(21) Appl. No.: 09/965,405

(22) Filed: Sep. 26, 2001

(51) Int. Cl.
*G06Q 30/00* (2006.01)

(52) U.S. Cl. ..... 705/26

(58) Field of Classification Search ..... 705/26, 705/28, 27
See application file for complete search history.

(56) References Cited

U.S. PATENT DOCUMENTS

| | | | | |
|---|---|---|---|---|
| 6,029,141 | A | 2/2000 | Bezos et al. | |
| 6,108,639 | A * | 8/2000 | Walker et al. | 705/26 |
| 6,167,378 | A * | 12/2000 | Webber, Jr. | 705/8 |
| 6,246,998 | B1 * | 6/2001 | Matsumori | 705/27 |
| 6,263,317 | B1 * | 7/2001 | Sharp et al. | 705/26 |
| 6,345,090 | B1 * | 2/2002 | Walker et al. | 379/114.12 |
| 6,594,640 | B1 * | 7/2003 | Postrel | 705/14 |
| 6,850,901 | B1 | 2/2005 | Hunter et al. | |
| 6,868,401 | B1 * | 3/2005 | Carpenter et al. | 705/37 |
| 6,871,232 | B2 * | 3/2005 | Curie et al. | 709/225 |
| 6,901,380 | B1 * | 5/2005 | Bremers | 705/27 |
| 2001/0002464 | A1 * | 5/2001 | Hogan | 702/186 |
| 2002/0007302 | A1 * | 1/2002 | Work et al. | 705/10 |
| 2003/0023464 | A1 | 1/2003 | Burk | |
| 2003/0046120 | A1 | 3/2003 | Hoffman et al. | |
| 2003/0069774 | A1 | 4/2003 | Hoffman et al. | |
| 2003/0083918 | A1 | 5/2003 | Hoffman et al. | |

OTHER PUBLICATIONS

Radosevich et al., "IT eyes reseller channel changes", Inforworld, vol. 21, No. 8, pp. 33.*
Waybackmachine: www.carteretmortgage.com (Mar. 3, 2001).
"Colorful criteria . . . ," Jun. 23, 1999, Canadian Computer Reseller, Rogers Publishing Limited, Toronto, vol. 12, Iss. 12, p. 39.
Kalyanam, Kirth, et al."Hewlett Packard Consumer Products Business Orginization . . . ;"John Wiley & Sons, Inc.;Journal of Interactive Marketing, v13,n4;pp. 51-64; Autumn 1999.
Shuster, Lauries, "A host of niches (Green Hill Ace hardware, Morton Conneticut) (Niche Marketing);"Chilton's Hardware Age, v228,n8,pp. 261-262; Aug. 1991.
Eastwood, Alison; Holloway, Andy (Interviewers); "Two-tier talkers [Roundtable discussion];" Canadian Computer Reseller, v11,n23;p. 35(8 pages); Dec. 2, 1998.

* cited by examiner

*Primary Examiner*—Ronald Laneau

(57) ABSTRACT

A method for a first organization to do business including entering into a contractual relationship with a second organization to deliver products and services to a customer.

17 Claims, 12 Drawing Sheets

METHOD OF DISTRIBUTING

FIELD OF THE INVENTION

The present invention relates generally to a method of doing business, and more particularly, to a method of doing business involving a first organization and a second organization which cooperate to provide products and/or services to customers.

RELATED APPLICATIONS

The present application is related to the following U.S. patent applications all having the same filing date as the present application and which are each hereby incorporated by reference for all that is disclosed therein: U.S. patent application Ser. No. 09/965,404 for METHOD OF COMPENSATION of Tami Guy et al., U.S. patent application Ser. No. 09/965,402 for METHOD OF RECOGNIZING REVENUE of Tami Guy et al., U.S. patent application Ser. No. 09/965,332 for METHOD FOR QUALIFYING AN ORGANIZATION of Tami Guy et al., U.S. patent application Ser. No. 09/965,403 for METHOD FOR MONITORING PERFORMANCE OF AN ORGANIZATION of Tami Guy et al., U.S. patent application Ser. No. 09/965,460 for METHOD OF DOING BUSINESS of Tami Guy et al., U.S. patent application Ser. No. 09/965,459 for METHOD OF CREDIT APPROVAL of Tami Guy et al.

BACKGROUND OF THE INVENTION

Conventional Business Models

There are several conventional methods and systems for distributing products and providing services to a customer. Particular examples of conventional methods include reseller/distributor/manufacturer (RDM) arrangements, company-owned resellers, multi-level marketing programs, franchises, and direct sale programs.

The reseller/distributor/manufacturer (RDM) arrangement is the most common mechanism for delivery of products. In the RDM model, a product is manufactured by a manufacturer. After manufacturing, the product is shipped to a distributor. The distributor then provides the product to a reseller. The reseller then sells the manufactured product to the customer. In the RDM model, products take a lengthy amount of time to flow through the distribution channel. Additionally, the price paid by the customer is inflated due to the two-levels of markup. This markup is typically a 5-10% markup by the distributor and a 5-10% markup by the reseller. An additional consideration of the RDM model is the difficulty or inability to provide support services to maximize performance of the product. The lack of support services is evident in many arrangements such as mass retailers, discount stores, internet sales, and the like. The RDM model thus often results in relatively slow time-to-market, high cost to the customer, inadequate technical support and poor access to the manufacturer for warrantee service.

The company owned reseller model has a distribution channel wherein the manufacturer is the owner of at least some reseller facilities. These reseller facilities sell products in a similar manner to the conventional R/D/M model. A customer purchases the manufactured goods from the company owned reseller. This model is advantageous because the manufacturer can control the product purchase experience of the customer. An additional benefit of this model is the ability to provide ancillary services to the customer. Services that may be provided include warranty work, routine maintenance, technical assistance, onsite service and the like. Conventionally, this model is difficult to implement because the philosophy and culture of a manufacturer is very different from the philosophy and culture of a reseller. Additionally, this model places a heavy financial and time burden on the manufacturer to build reseller facilities, hire management, train employees, etc. Many manufacturers have tried this distribution model, ultimately finding that they are unable to build enough reseller facilities and hire enough staff to implement this model. Additionally, manufacturers that enter into the reseller's environment through company owned reselling often alienate conventional resellers. As a result, the alienated resellers defect to competitive products thereby diluting the manufacturer's reseller base.

In multi-level marketing programs typically a variety of goods are sold by an individual on behalf of a distributor. The individual obtains orders from customers for the distributor's products and places the order with the distributor. The distributor delivers the products to the customer. The individual is commonly paid a percentage of the product sales price by the distributor. There is typically no qualification process by which individuals are selected. As a result, unscrupulous individuals erode the reputation of the competent individuals. One advantage of this system is that there is no need for the individuals to have a physical showroom or location. As a result the overhead for the individual is low and the overall profitability of the model often makes it financially feasible.

Regarding a franchise business, a franchisee (an entity that receives the business) enters into a business relationship with a franchisor (an entity that provides the business). The franchisor typically provides basic business assistance in a number of areas such as product sourcing, site selection, marketing, quality control, employee benefits, accounts receivable, accounts payable, taxes, licenses, etc. There is usually an initiation fee paid by the franchisee to the franchisor at the beginning of the franchise relationship. Additional revenue is usually realized by the franchisor through fixed fees and/or royalties paid by the franchisee.

In a direct sale program the manufacturing entity sells products to a customer directly. The sale is often generated through targeted marketing efforts such direct mailings, advertising or other special promotions. When implementing direct sales programs, it is often difficult for the manufacturer to entice resellers to carry the manufacturer's products. The difficulty in obtaining resellers arises because manufacturers often discount their prices below the suggested retail price. Conventional retailers usually cannot compete with prices that are below the suggested retail price; therefore they look to other manufacturers for products to sell.

In most conventional distribution models such as those previously discussed, the manufacturer may be paid only approximately 50% of the sales price to the customer. The above discussed reseller models have a local reseller and a manufacturer which are completely separate entities. Since the reseller and the manufacturer are separate, there are inefficiencies in time-to-market and in financial transactions. Current manufacturer revenue is solely for the product the manufacturer sells at its sales price to the reseller. Additionally, the customer has no direct contact with the manufacturer, which in many cases has an established reputation for quality and reliability. Instead, the customer must work with an independent, sometimes unqualified and/or unreliable, reseller.

SUMMARY OF INVENTION

In one embodiment the invention may comprise a method for a first organization to do business comprising entering into a contractual relationship with a second organization; authorizing the second organization to take an order from a customer, the order comprising at least one of: products not produced by the first organization, and services not provided by the first organization; receiving payment directly from the customer as a payment for the order taken by the second organization; requiring an organization other than the first organization to ship products not produced by the first organization to the customer; requiring an organization other than the first organization to provide services to the customer.

In another embodiment the invention may also comprise a method for a first organization to business comprising requiring a second organization to take an order for sales items on behalf of the first organization; in response to a determination that the order includes a product distributed by a third organization sending an order for that product to the third organization; requiring the third organization to ship the product directly to the customer's address.

In another embodiment the invention may also comprise a method for a first organization to do business comprising requiring a second organization to take an order for sales items on behalf of the first organization; in response to a determination that the order includes a product distributed by a third organization sending an order for that product to the third organization; requiring the third organization to notify the first organization when the order exceeds a predetermined credit limit of the second organization.

In another embodiment the invention may also comprise a method for a first organization to do business comprising in response to a determination that services in a service order taken by a second organization on behalf of the first organization is incomplete determining whether the service order includes support services; and determining a billing strategy based upon whether or not the service order includes support services.

DETAILED DESCRIPTION OF THE INVENTION

Overview

The specification and drawings describe how a first organization (O1) implements a program for doing business which involves at least a second organization (O2). In this method of doing business, the first organization (O1) and the second organization (O2) provide products and services to customers in a particular market. As used herein, the term organization means any legal person including natural persons; artificial persons, such as corporations and limited liability companies; groups of legal persons acting in concert such as partnerships and joint ventures; and any entity required to file state or federal income tax returns. When reference is made to a "first organization," a "second organization" and a "third organization" herein it is to be understood that the three organizations are legally separate and distinct entities.

The first organization is typically a product manufacturer or other organization with product supply capabilities.

The second organization is typically an organization experienced in selling products of the type produced by the first organization and providing services related to such products.

One aspect of the program is top-line revenue recognition (i.e. the entire sale price of the product and/or service to the customer) to the first organization. First organization revenue recognition may be for all products and services sold by the second organization, and invoiced in the first organization's name including products produced by third organizations. The first organization may handle all credit to and collections from the customer.

Figure 1:
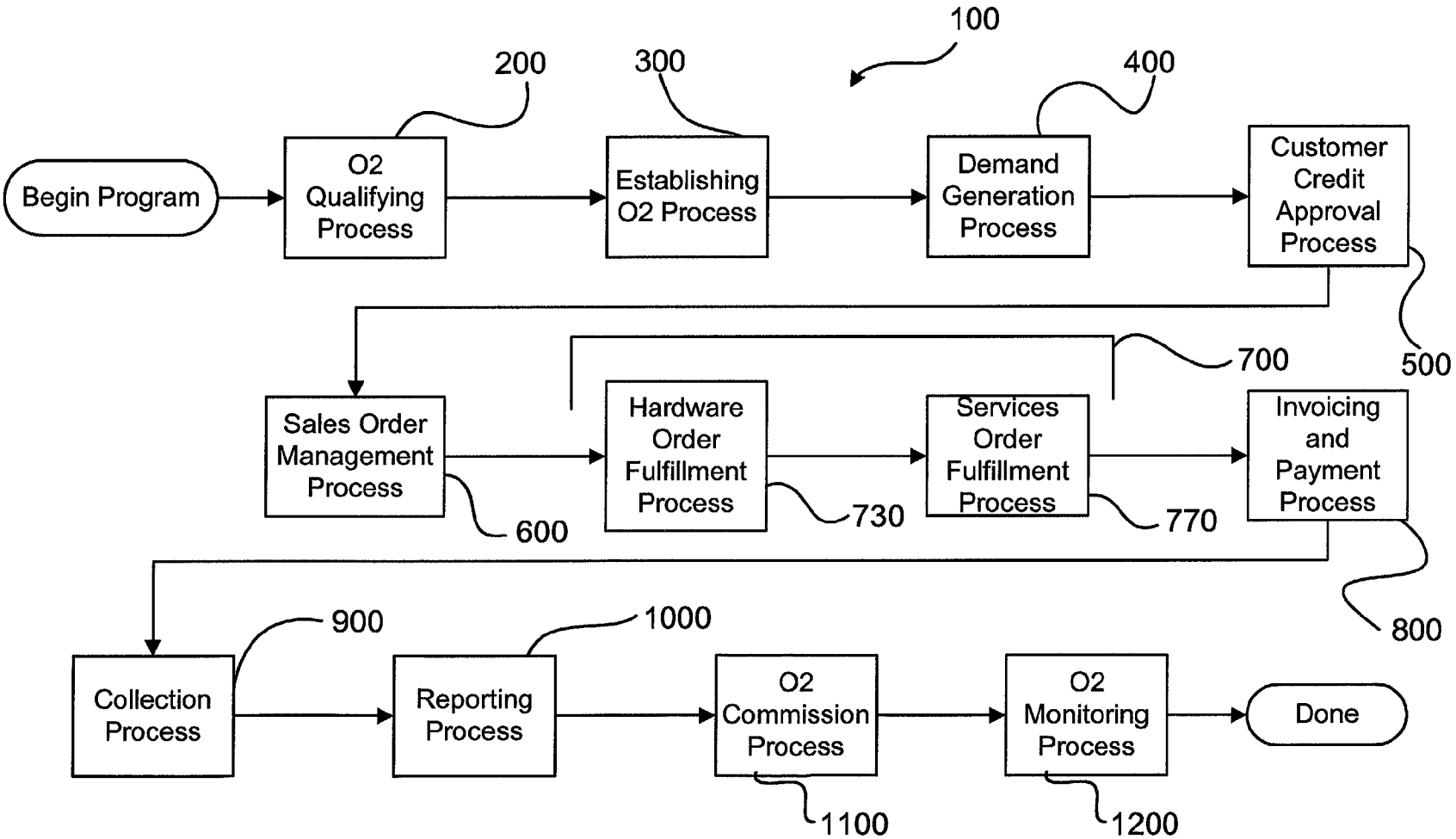
FIG. 1 is a schematic flowchart representing individual processes of a program for doing business.

Referring to FIG. 1, a program flowchart 100 graphically represents the program. The program 100 may include a second organization qualifying process 200, an establishing second organization process 300, a demand generation process 400, a customer credit approval process 500, a sales order management process 600, an order fulfillment process 700 (the order fulfillment process 700 may include a hardware order fulfillment process 730 and a services order fulfillment process 760), an invoicing and payment process 800, a collection process 900, a reporting process 1000, a second organization commission process 1100 and a second organization monitoring process 1200. The individual processes are described in detail below.

This program may be implemented in most industries. The exemplary implementation specifically described herein is in the computer industry involving the sale of computer hardware and ancillary services. "Product" in this exemplary implementation means hardware, software, documentation, accessories, supplies and upgrades and other tangible items or information that are available for sale from first organization or the third organization(s) as described further below. "Services" in this exemplary implementation means device consulting, configuration, installation, device maintenance and repair, software updating and maintenance, training and other standard support services for products of the type sold in the program. In discussing the implementation of the program, different processes and sub-processes will be described as being performed by the second organization or the third organization. It is to be understood that such performance by the second organization or third organization(s) is required by the first organization either by contractual agreement or as an understood requirement for maintaining an existing business relationship with the first organization.

It is to be understood that this exemplary description of the program 100 and various processes 200-1200 are provided for illustrative purposes only as an aid in understanding the program and is not to be used in any way to limit the scope of the appended claims.

Second Organization Qualifying Process

Figure 2:
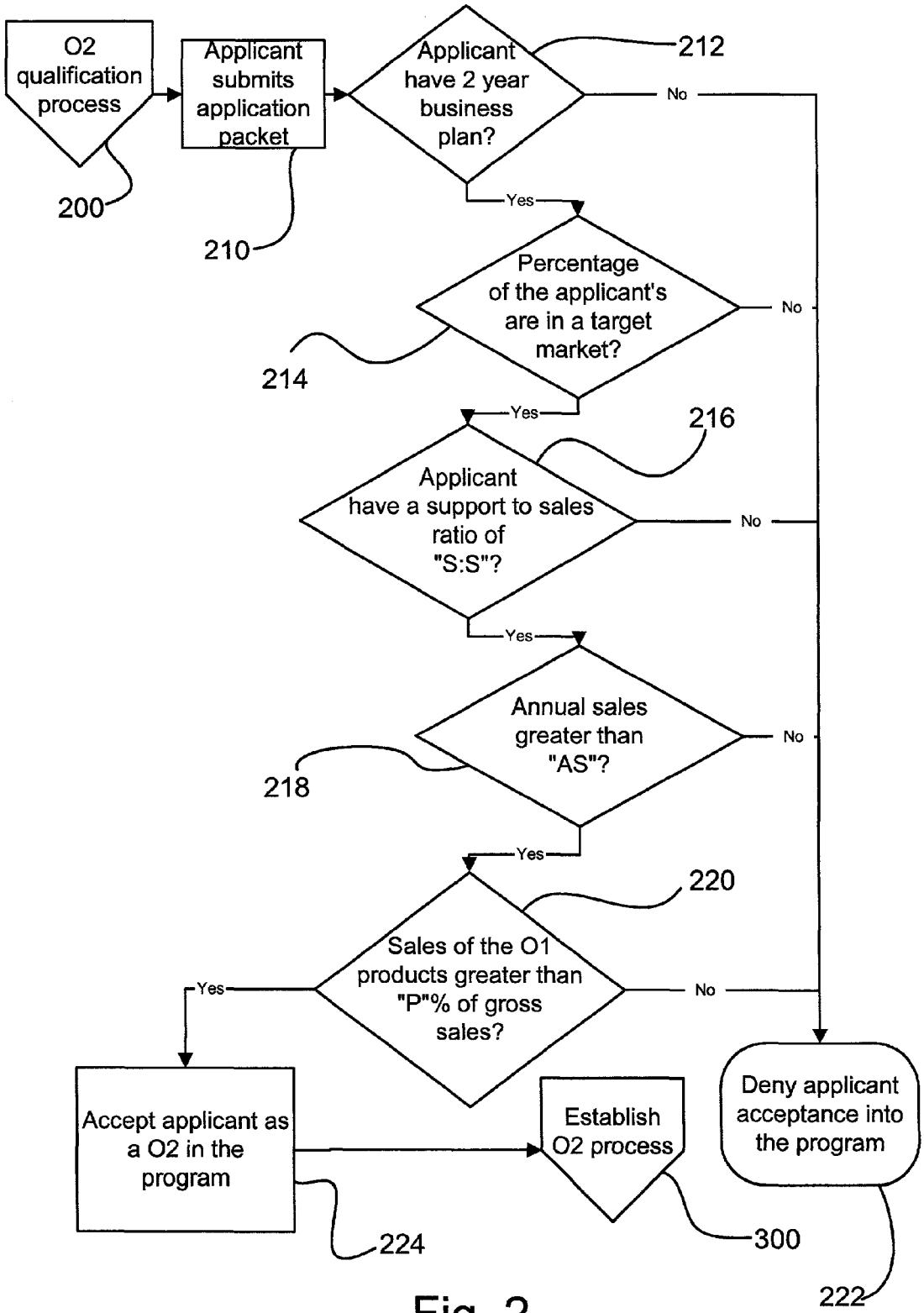
FIG. 2 is a schematic flowchart representing a second organization qualifying process of the program of FIG. 1.

Referring to FIG. 2, the second organization qualifying process 200 may be provided for ensuring that the first organization enters into relations with competent second organizations. Competent second organizations are entities that meet particular requirements indicative of their potential success in the program. The second organization qualifying process 200 may commence when the applicant submits an application packet 210. The application packet may include documents to be completed by the applicant which contain a number of questions. Some qualifying questions may include: Does the applicant have a two-year business plan 212? What percentage of customers is in the target market 214? Does the applicant have an adequate support to sales ratio 216? Are the annual sales greater than a predetermined amount 218? Are the sales of the first organization's products greater than a predetermined percentage of the gross sales 220? These above sample questions are merely exemplary and not to be construed as the only qualifying questions which may be asked, or as questions which all must be asked for qualifying purposes.

In one exemplary implementation of the qualifying process 200 in which the first organization is a large computer company, the following list of requirements must be met. Regarding the financial requirements, the minimum total annual sales of the second organization's existing business is $2.5 million. The minimum percentage revenue growth in the second organization's existing business from previous year is at least 30%. A minimum of 30% of the previous year's total revenue is from sales of the first organization's hardware. A minimum of 30% of the second organization's previous year's total revenue is from services. Small-sized and medium-sized customers (organizations with 500 or fewer employees) comprise a minimum of 70% of the second organization's total customer base. Minimum sales per salesperson in the second organizations sales group must be $1 million. Minimum ratio of on-site support personnel to sales people must be 2:1. Minimum ratio of on-phone technical support to salespeople must be 1:1. A complete business plan with a two-year minimum outlook must exist. Financial stability of the second organization as demonstrated by the most recent two years income statements and balance sheets according to predetermined accounting standards. Regarding certifications and authorizations, the second organization must have a minimum of one staff person certified for a predetermined list of products and/or services. (For example, the second organization could be required to have a MICROSOFT Solution Provider certification and a minimum of one technical staff person that is a MICROSOFT Certified Systems Engineer (MCSE); one staff person that is either CISCO Certified Network Associate (CCNA) or Certified NOVELL Associate (CNA) certified and qualified to perform the services of consulting customers for information technology needs and assessments.) The staff must be able to provide products and services recommendations for "end-to-end" solutions. For example, the staff of the second organization must be able to configure, install and test hardware and software. The staff should be qualified to also install cabling/LAN infrastructure, upgrade hardware and software, provide web design and other e-commerce design services and advise on and configure firewalls. Additionally, the staff should be able to train customers at the customer's site, provide break-fixed warranty services and provide on-going customer support services at a customer requests. The second organization facility must be able to communicate customer traffic (i.e. customers may bring in products to be serviced or come into the facility for a meeting.) Additionally the facility must have a product demonstration area, a training and conference area, on-site bench repair and a minimum high quality sales and service coverage area of 50-100 mile radius from the facility.

Final qualification of the second organization is subject to inspection of its facility, a check of ten customer references, a review of the two-year business plan and a review of audited income statements and balance sheets (last year and current). Again, the above requirements are only non-limiting examples of qualifying criteria that may be used.

Figure 3:
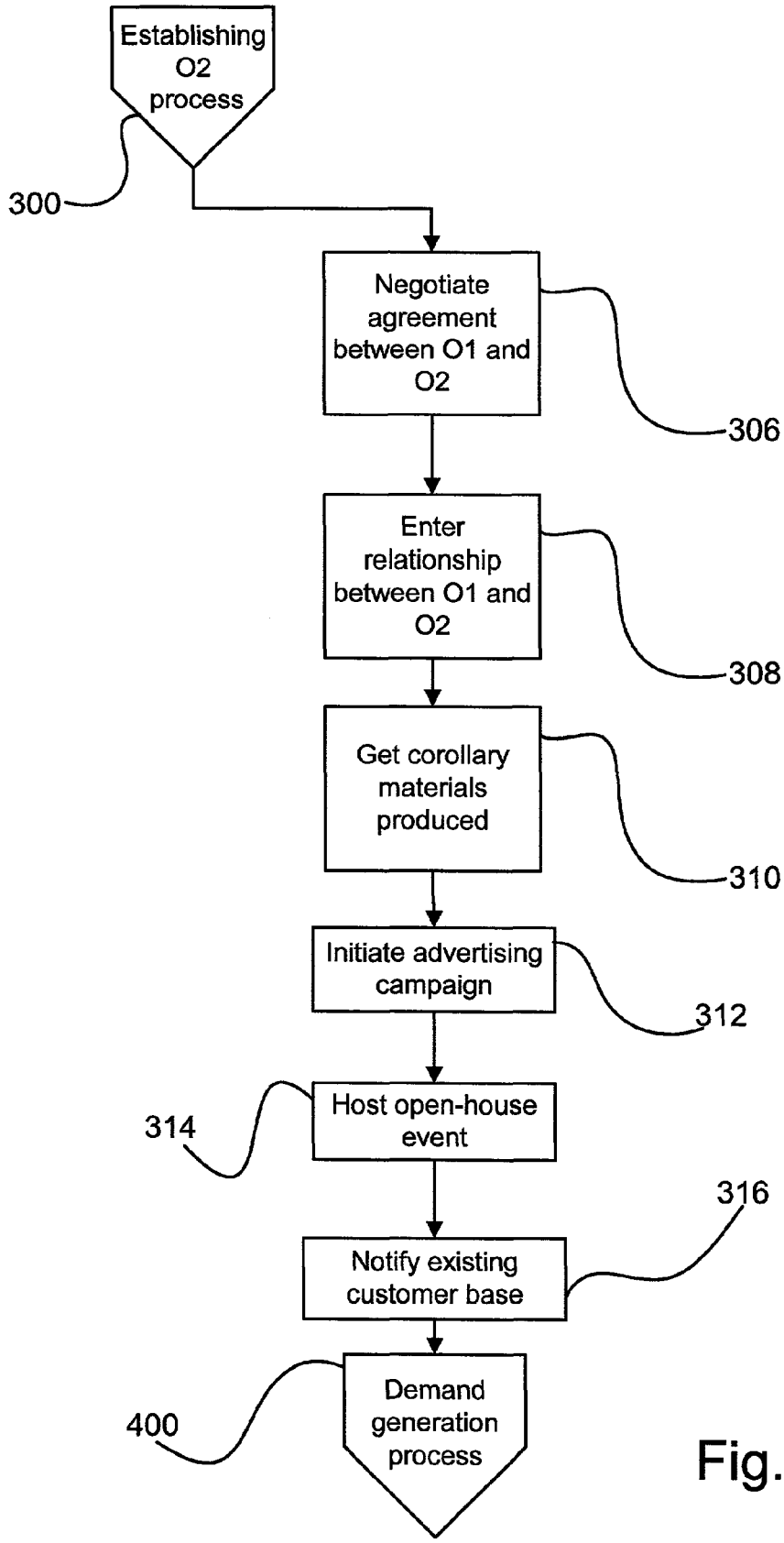
FIG. 3 is a schematic flowchart representing an establishing second organization process of the program of FIG. 1.

If the applicant does not satisfy the qualifying criteria, then the first organization denies applicant acceptance into the program 222. On-the-other-hand, if the applicant has proven likelihood of success in the program by meeting the requirements, then the first organization accepts the applicant as a second organization in the program 224. Upon acceptance into the program, the first organization and the second organization may begin an establishing second organization process 300 (FIG. 3).

Regarding the evaluation process, one method for evaluating the applicant's likelihood of success may be through mathematical calculation involving weighted scores. In this evaluation method the importance of each individual criterion may be determined. After determining the importance the criteria, each criterion may be assigned a range. More revealing criteria will receive greater ranges, while less revealing criteria will receive smaller ranges. For example, if the annual sales greater than the predetermined amount 218 is determined to be a very revealing criterion of the applicant's success in the program, then it may receive a range of one to twenty (twenty being the highest amount of sales). On the other hand, if the applicant's support to sales ratio 216 is not a particularly revealing criterion of the applicant's likelihood of success in the program, then it may receive a range of one to five (five being the highest ratio). Once all of the applicant's responses are provided and ranked, the values may be totaled. The totaled values for various applicants may be compared to determine which applicants are most likely to succeed in the program.

The above is only one example of mathematical methods for evaluating the applicant's likelihood of success. Other mathematically based formulas or modification of the one described above may be provided as deemed appropriate by the first organization. One example is requiring a minimum preset passing score for every criterion on the list. As another example, some criteria may be considered so important that a preset minimum score must be obtained in such criteria to avoid disqualification while requiring a minimum combined score as well. Alternatively the criteria may be used as only guidelines to be considered by the decision maker(s) with the final decision based on the overall impression of the decision maker(s). As another alternative, a combination method could be used with mathematical determinations used for some criteria and overall impression used for other criteria.

Second Organization Monitoring Process

Ongoing second organization metrics may be provided for evaluating the second organization's performance in the program during a second organization monitoring process 1200. Although the second organization monitoring process 1200 is shown in the block diagram of FIG. 1 as the last block in the chain, it is to be understood that the various processes 200-1200 shown in this diagram need not necessarily be performed in the order shown and need not all be performed. For example, the monitoring process may commence immediately after the second organization qualifying process and may continue concurrently with all of the other processes. The second organization metrics may be provided with a number of categories that second organizations would be measured against on a regular basis throughout the duration of the program, e.g. annually. Noncompliance with these metrics for a predetermined period of time may result in revocation of the second organization's qualification and ultimately termination from the program. Creation and enforcement of these metrics are for the purpose of ensuring a high level of customer satisfaction, committed sales efforts and efficient operations. These categories of second organization metrics may include: 1) customer satisfaction goals such as: customer satisfaction survey scores, first time fix rate on break-fix work, delivery commitment to dates and response/follow through on first organization dispatch requests; 2) sales goals such as sales growth goals by category, actual orders/shipments/invoices to forecast, sales agreements processed, first organization hardware sales percentage of total sales revenue, services percentage of total revenue; 3) operation goals such as: the number of customers having bad debt to the first organization must be less than a preset number, the product return ratio must be below a preset number, a preset ratio of deliveries must be on-time and a preset ratio of sales reports must be on-time.

Establishing Second Organization Process

Referring to FIG. 3, an establishing second organization process 300 may be provided for initiating the relationship between the first organization and the second organization and increasing the probability that the second organizations will be successful. The establishing second organization process 300 may include taking a number of actions that may be performed either by the first organization, the second organization or an independent organization. These actions may include entering into a relationship (e.g. a written contractual relationship) between the first organization and the second organization. Additionally the establish second organization process 300 may include negotiating the terms of the relationship between the first organization and the second organization 306 and entering the relationship between the first organization and the second organization 308. Additionally, support materials may be produced such as business cards, signage, employee clothing, etc 310. These actions may further include initiating advertising campaigns within the second organization's locality 312. These actions may also include hosting an open-house event (for example at the second organization facility) to welcome the new second organization and its existing customers 314. These actions may further include notifying existing customers of the second organization and of the new relationship between the first organization and the second organization 316.

The aforementioned tasks are provided for exemplary purposes and are not to be construed as being tasks that must always be performed or as a complete list of tasks; other tasks may be performed as deemed appropriate. Following the second organization initiation process 300, the demand generation process 400 may commence.

Demand Generation Process

Figure 4:
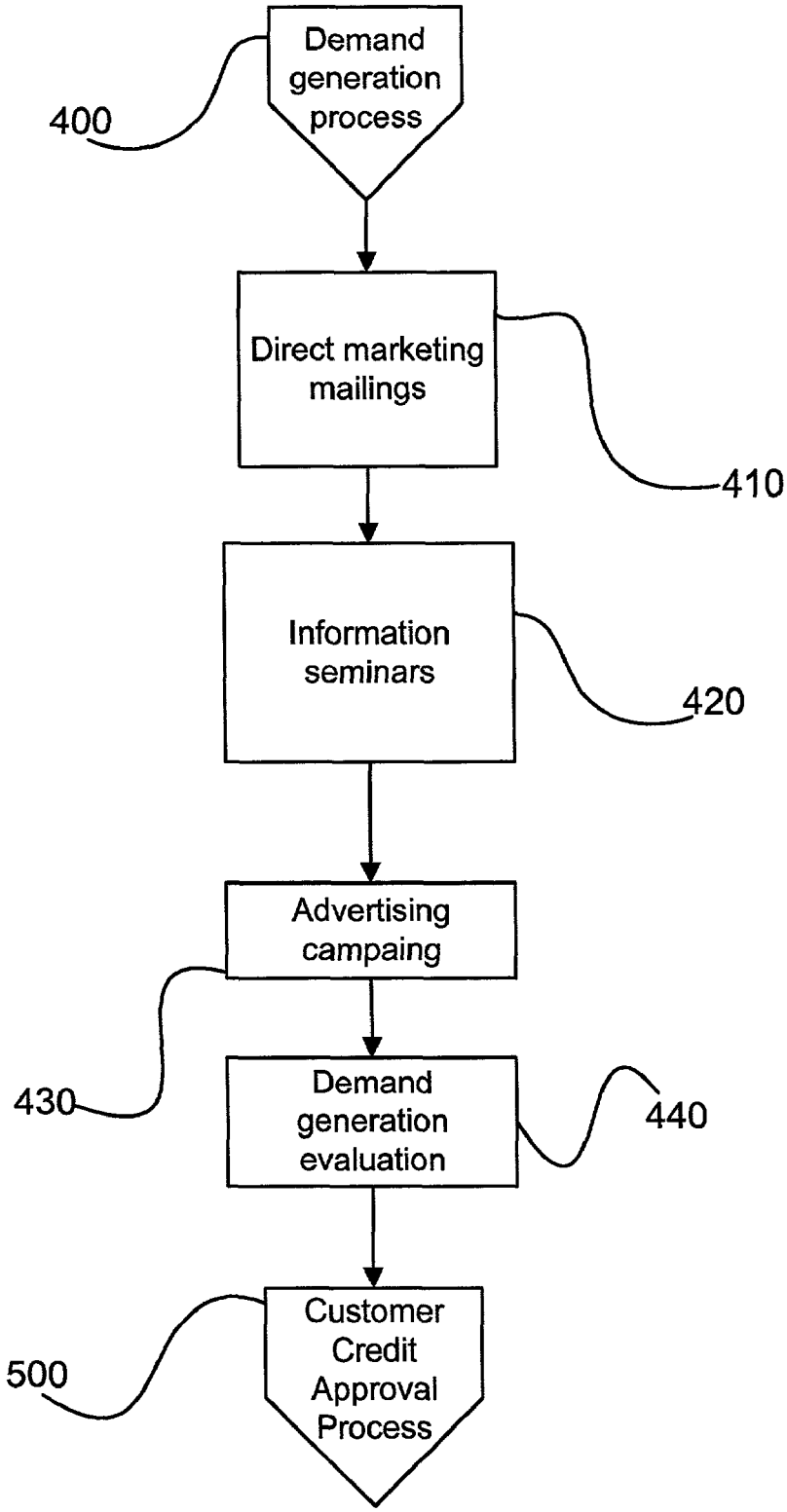
FIG. 4 is a schematic flowchart representing a demand generation process of the program of FIG. 1.

Referring to FIG. 4, a demand generation process 400 may be provided to generate inquiries from and sales to the relevant market, e.g. the small/medium business (SMB) market. A particular example of a task that may generate demand is direct marketing mailings 410. Additionally, information seminars may be hosted 420 for educating customers of new products to generate demand. Other demand generation processes may be provided such as advertising campaigns 430. For example, the first organization could commit to a minimum number of campaigns with promotional offers in the local geographic area of each second organization. Additionally, a demand generation evaluation process 440 may be provided in order to ensure that the demand generation process 400 is effective.

In order to help the second organization to best service the customers within their local geographic area, the first organization may require that each second organization refer all service inquiries from prospective customers located outside of the service area to the first organization so that the first organization can refer those inquires to another "second" organization (i.e. another organization having the same type of relationship with the first organization as the second organization) responsible for the geographic area of the inquiry. The first organization may also authorize the second organization in writing to extend the service area from time to time, or on a case-by-case basis. Upon completion of the demand generation process 400, the credit approval process 500 may commence.

Customer Credit Approval Process

Figure 5:
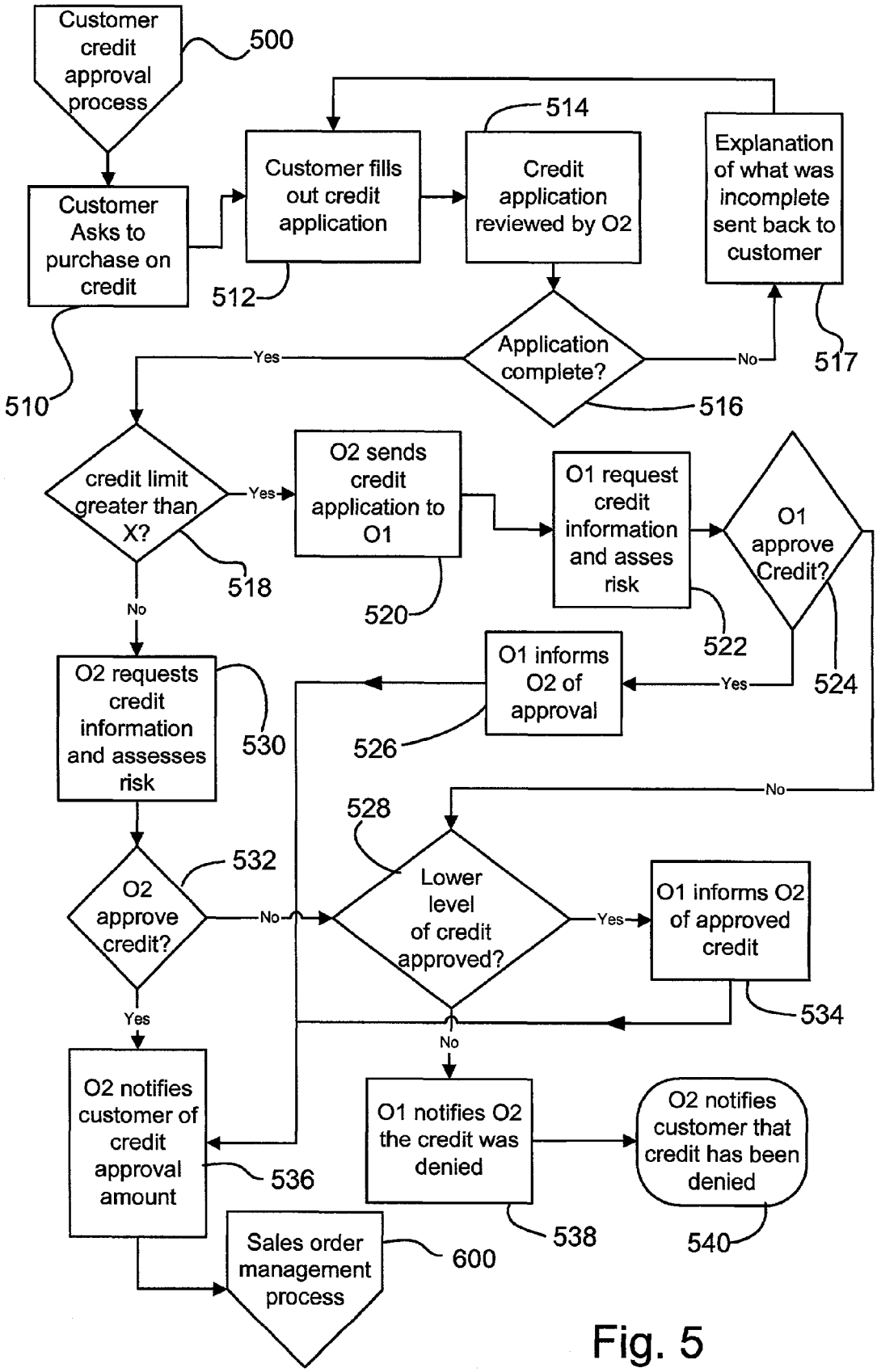
FIG. 5 is a schematic flowchart representing a customer credit approval process of the program of FIG. 1.

Referring to FIG. 5, a customer credit approval process 500 may be provided for determining the amount of credit a customer is capable of managing properly. The customer credit approval process 500 may be initiated by the customer asking to purchase on credit 510. In response to the inquiry, the second organization may provide a credit application for the customer to complete 512. The completed credit application may then be reviewed by the second organization for completeness 514. Based on the second organization's review, a decision regarding the applications completeness 516 is made. If the credit application is complete, the amount of credit desired is evaluated 518. The second organization has a predetermined credit limit they are able to approve on the first organization's behalf. If the application is incomplete, the applicant is notified of the incompleteness of the application 517 and the applicant completes the credit application 512 again. Referring back to the "credit limit greater than "X" process" 518, if the credit limit is not greater than some predetermined amount "X", e.g. $5,000, the second organization requests credit information and assesses the risk 530. Based on a favorable second organization determined credit approval decision 532, the second organization notifies the customer of the credit approval amount 536. Upon notifying the customer of the credit approval 536, a sales order management process 600 may be initiated. If the first organization does not approve credit amount originally applied for, the first organization makes a decision 528 on approving a lower level of credit, e.g. $2,000. If the lower level of credit 528 is approved by the first organization, then the first organization informs the second organization of the approved credit 534 and the second organization notifies the customer of the credit approval amount 536. If the lower level of credit 528 is denied, then the first organization notifies the second organization that the credit was denied 538 and the second organization notifies the customer that the credit has been denied 540. Referring back to the "credit limit greater than "X" process" 518, if the amount is greater than "X", then the second organization sends the credit application to the first organization 520. The first organization evaluates the credit request in-view-of the credit application 522. Upon analyzing the application, the first organization analyst makes a decision on approving the credit 524. If credit is approved, then the first organization informs the second organization of the credit approval 526. If the credit decision is not favorable, the decision process for a lower level of credit approved 528 may be undertaken. Once the credit is approved for a customer, a sales order management process 600 may be provided.

Sales Order Management Process

Figure 6:
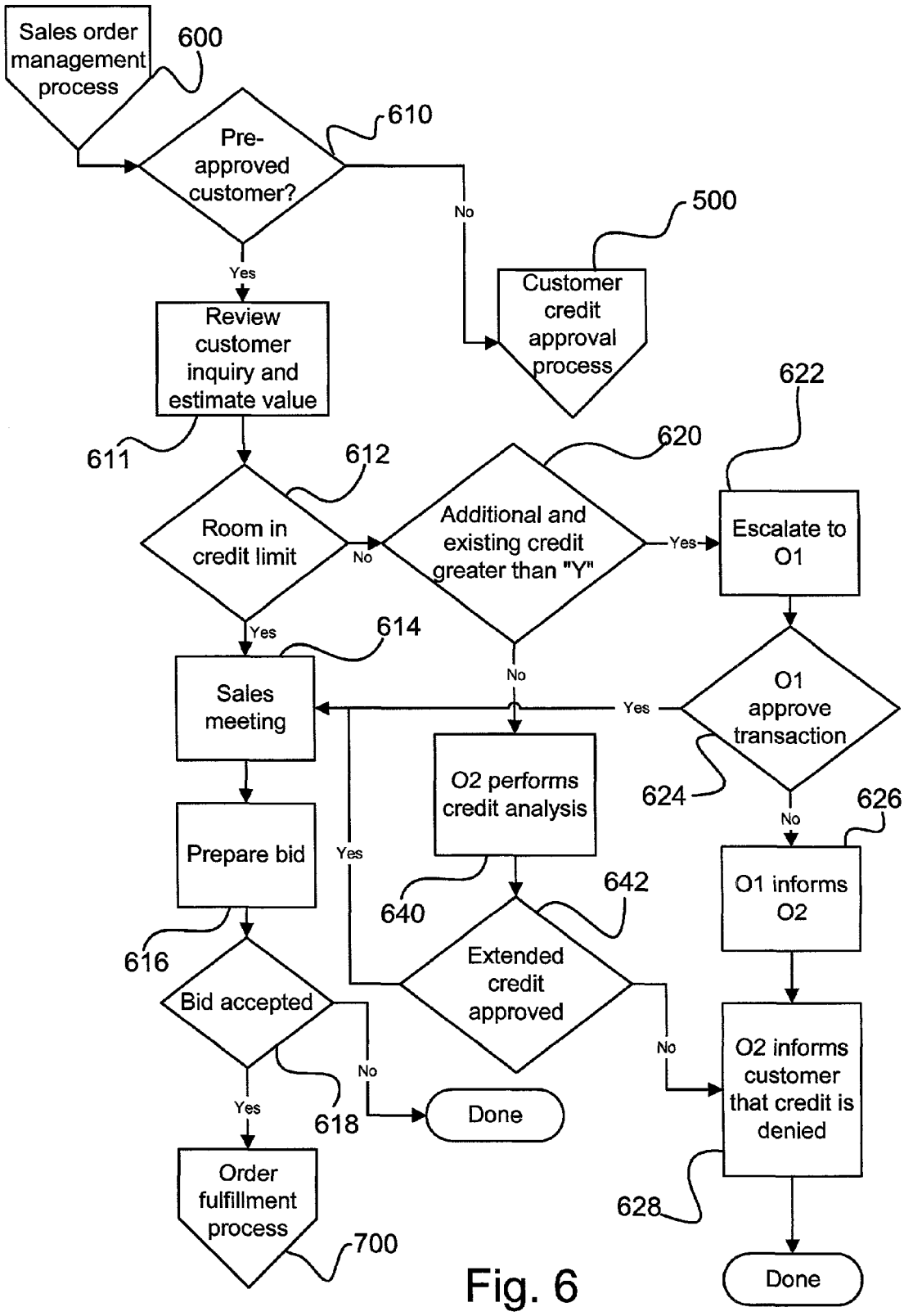
FIG. 6 is a schematic flowchart representing a sales order management process of the program of FIG. 1.

Referring to FIG. 6, a sales order management process 600 may be provided for managing and ensuring proper accounting of a sale. The process may continue with the inquiry of credit approval of the customer 610. The process may begin with a review of customer inquiry and estimate value 608. If the customer is not already approved for credit, then the customer goes through the previously described customer credit approval process 500. In the event that the customer is pre-approved for credit, then a review of customer inquiry and estimate value 611 may be provided. Next, the amount of available credit may be evaluated 612 in comparison to the estimated value. In the event that there is enough available credit, e.g. the customer has a $20,000 credit limit and the target price of the products the customer is interested in purchasing is $15,000, the a sales meeting 614 may be conducted between the second organization and the customer. After the sales meeting 614, the second organization may prepare 616 a bid and provided the bid to the customer. Next the customer decides 618 whether or not to accept the bid. If the customer accepts the bid, then the order fulfillment process 700 may commence. If the customer does not accept the bid, then the sales order management process 600 is complete. Referring back to the room in credit limit 612 decision, if enough credit when compared to the estimated value determined in process 611 is not available, then the amount of additional credit needed is evaluated to determine if is greater than a predetermined amount "Y" 620. If the credit required is greater than "Y", then the order may escalate to the first organization credit 622 for further review. The first organization may approve or deny the transaction during a first organization approval decision 624. If the transaction is not approved, then the first organization informs the second organization 626. After the first organization informs the second organization, the second organization informs the customer that credit is denied 628. Referring back to the first organization credit approval transaction decision 624, if the credit is approved then the sales meeting 614 between the customer and the second organization is initiated. Referring back to the "additional and existing credit greater than "Y"" 620 decision, if the outcome is negative, the second organization may perform a credit analysis 640. After performing a credit analysis 640, the second organization decides 642 whether or not to extend the additional credit. If the extended credit is denied, then the second organization informs the customer that credit is denied 628. In the event that the extended credit is approved, a sales meeting 614 is initiated. After completing the sales order management process 600, the order fulfillment process 700 may commence. In an alternative embodiment, the first organization may be the only organization capable of extending credit. In this alternative embodiment, the outcome of the additional and existing credit greater than "Y" decision 620 may always result in an escalation to the first organization 622.

Order Fulfillment Process

As shown in FIG. 1, the order fulfillment process 700 may include two components. The first component of the order fulfillment process 700 may be the hardware order fulfillment process 730 (FIG. 7) and the second component may be the services order fulfillment process 770 (FIG. 8).

Hardware Order Fulfillment Process

Figure 7:
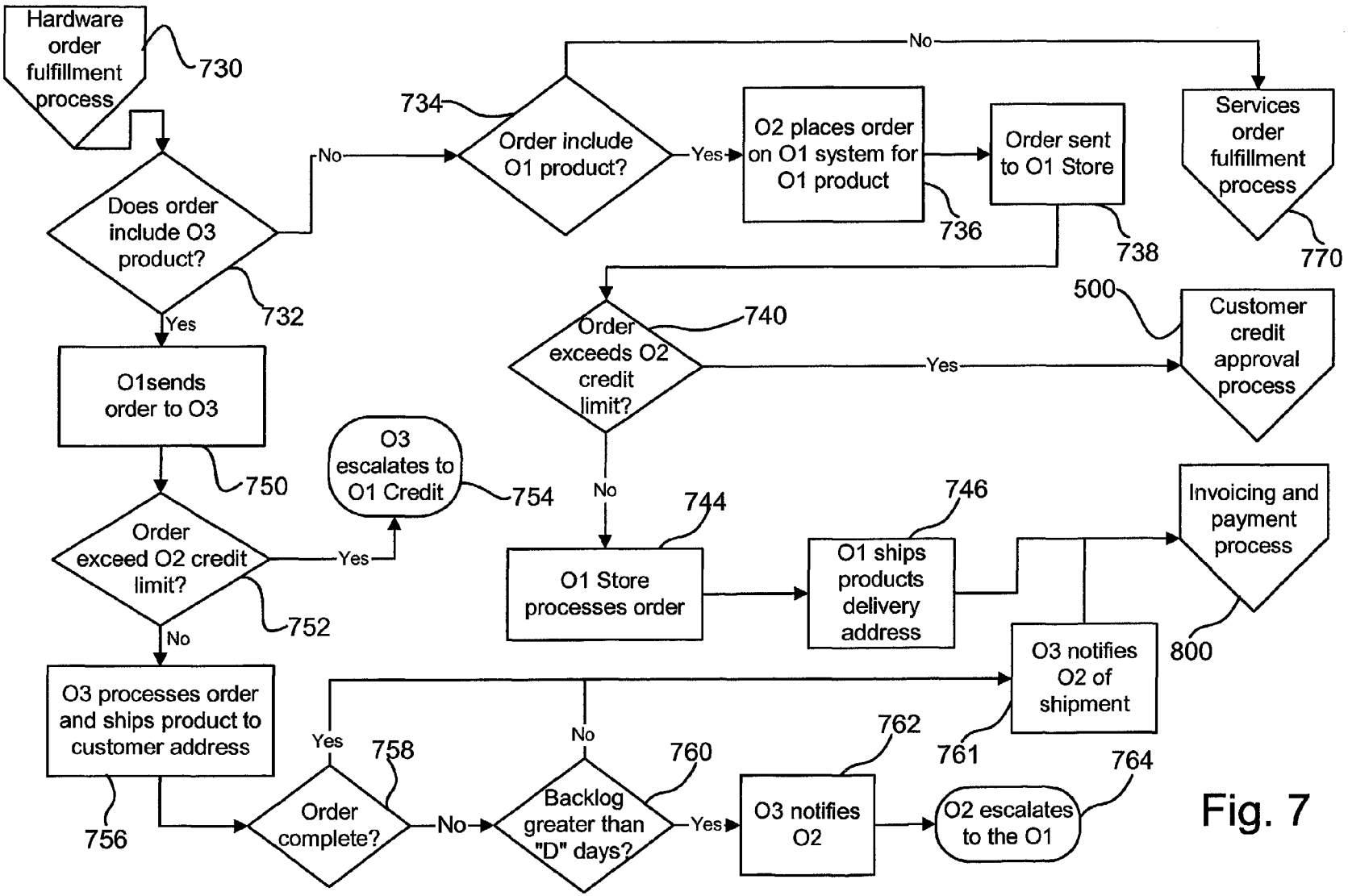
FIG. 7 is a schematic flowchart representing a hardware order fulfillment process of the program of FIG. 1.
Figure 8:
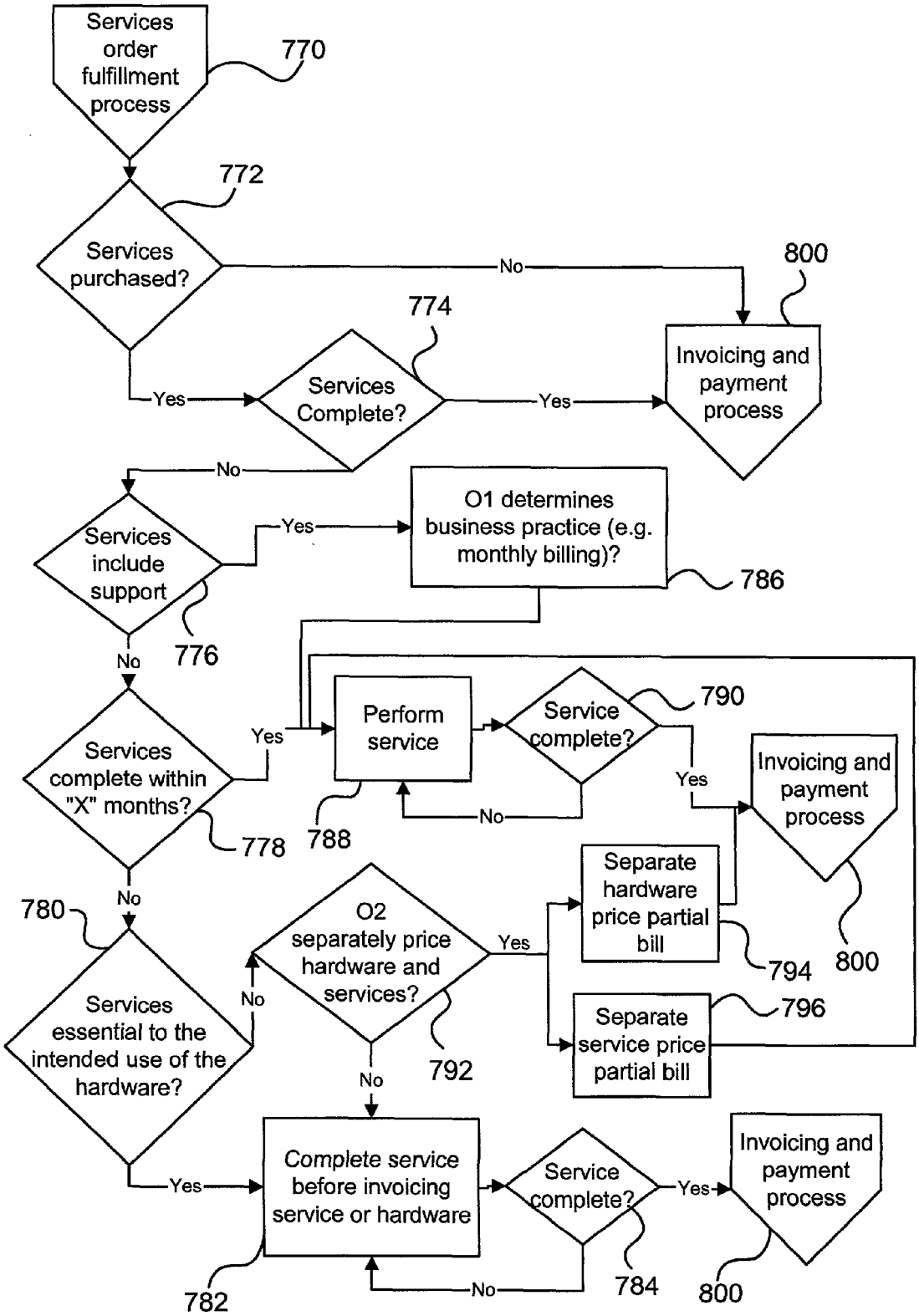
FIG. 8 is a schematic-flowchart representing a services order fulfillment process of the program of FIG. 1.

Referring to FIG. 7, the hardware order fulfillment processes 730 may commence with an inquiry as to whether the order includes a third organization product 732. If the order does not include third organization products, it is determined whether the order includes a first organization product 734. If the order does not include first organization product the service order fulfillment process 770 is initiated. In the event that the order does include a first organization product, then the second organization places an order on the first organization system for the first organization product 736. After placing the order on the first organization system for first organization product 736 the order is sent to the first organization store 738. Next the order is checked to see if it exceeds the second organization credit limit 740. The second organization's credit limit is a predetermined amount. (Since a plurality of "second" organizations may exist under the program, it is necessary to ensure that the first organization is not overextending its financial means by controlling the amount of credit provided to each individual "second" organization.) If the outcome of the "order exceeds second organization credit limit 740" is positive, then the first organization business store escalates to a customer credit approval process 500 as previously described except with step 516 followed in all cases with step 520 and not 530. Referring back to the "order exceeds second organization credit limit 740" decision, if the outcome is negative, then the first organization store processes the order 744. After processing the order 744, the first organization ships the products to the customer address 746. After shipping the products to the customer address 746, the invoicing and payment process 800 may be initiated. Referring back to the "does order include third organization product 732" decision, if the outcome is positive, then the first organization sends the order to the third organization supplier 750. After sending the order to the third organization supplier 750, the order price is preferably checked against the second organization credit limit 752. The second organization credit limit may actually be a portion of the first organization's credit limit which the first organization, in a preferred implementation, requires the third organization supplier to monitor, as through a third organization credit limit issued to the second organization. Alternatively a first organization credit card or other credit instrument with a preset limit could be provided to the second organization. The first organization is ultimately billed and accountable for payment to the third organization supplier. The second organization credit is monitored and controlled either directly or indirectly by the first organization to ensure that the amount of credit that the first organization is liable for remains at a satisfactory level. If the outcome of the "order exceeds second organization credit limit" 752 decision is positive, then the third organization supplier or other credit monitoring body escalates the order to the first organization 754. Referring back to the "order exceeds second organization credit limit" 752 decision, if the outcome is negative, then the third organization processes the order and ships the product to the customer address 756. The order is checked for completeness 758, and if the order is complete the first organization is notified and the invoicing and payment process 800 may commence. If the order is determined to be incomplete 758, then the duration of the backlog is evaluated. If the order is backlogged more than "D" days, the third organization supplier notifies the second organization 762. After being notified of the long backlog, the second organization escalates the issue to the first organization 764 for further review. If the backlog is less than "D" days, then the invoicing and payment process 800 may be initiated.

The manner in which order verification processes like 758, 760, 762, 764, etc. are carried out may vary. For example the second organization may be given the responsibility of calling on the customer and/or the third organization supplier to verify the completeness of orders and of reporting the completeness status to the first organization. Alternatively, the third organization supplier could be given this reporting responsibility which could be implemented in its billing process. For example, the third organization supplier could indicate on its invoice whether or not the product has been shipped. Since it is possible that multiple third organization suppliers will be used, some more reliable than others, it is preferred that the responsibility of order completeness reporting be given to the second, organization. Additionally, all goods for which orders are taken by the second organization are goods not held in inventory by the second organization.

Services Order Fulfillment Process

The services order fulfillment process 770 may commence with a decision of evaluating if services were purchased 772. If services were not purchased, the outcome of the services purchased 772 decision is negative and the invoicing and payment process 800 with regard to the hardware purchase commences. If services were purchased, the completeness of the services is evaluated 774. If the services are complete, the invoicing and payment process 800 is commenced. It is important to note that the first organization does not recognize the revenue from services until the service is actually delivered. If the services have not been completed another decision process is initiated. The services are evaluated to see if support is included, 776. If support is not included with the service, a determination is made, 778, as to how long it will take to complete the services. If the services will not be completed within "X" months, then an inquiry if the services are essential to the intended use of the hardware 780 decision is made. If the services are essential, the service will be completed before invoicing for the service or hardware 782. The completeness of the service may be evaluated during a service complete 784 decision. If the outcome is negative, then the complete service before invoicing service or hardware 782 process may be repeated. If the outcome of the service complete 784 decision is positive, then the invoicing and payment process 800 may commence. Referring back to the "are services essential to the intended use of the hardware" 780 decision, if the outcome is negative the ability of the second organization to separately price for hardware and services 792 is determined. If they cannot do it, the "complete services before invoicing service or hardware" 782 action is taken. If the second organization can separately price for hardware and services, then a separate hardware price portion bill 794 is prepared by the second organization. After preparing the separate hardware price portion bill 794, the invoicing and payment process 800 is initiated. Additionally, if decision 792 is positive, then a separate service price portion bill 796 is prepared and a perform services 788 action is initiated. The perform service 788 action is also provided for a positive outcome from the will services be complete within "X" months 778 decision. After performing the service 788, the completeness of the service may be evaluated during a service complete 790 decision. If the outcome is negative from the service complete 790 decision, then the perform service 788 step may be repeated. If the outcome of the service complete 790 decision is positive the invoicing and payment process 800 may be initiated at which time the partial bill 796 may require adjustment. Alternatively, partial bill preparation 796 may be performed after the services have been rendered. Referring back to the "does service include support" 776 decision, if the outcome is positive, the first organization may determine the business practice 786 such as monthly billing or the like. After deciding the business practice 786, the perform service 788 step may be initiated.

Invoicing and Payment Process

Figure 9:
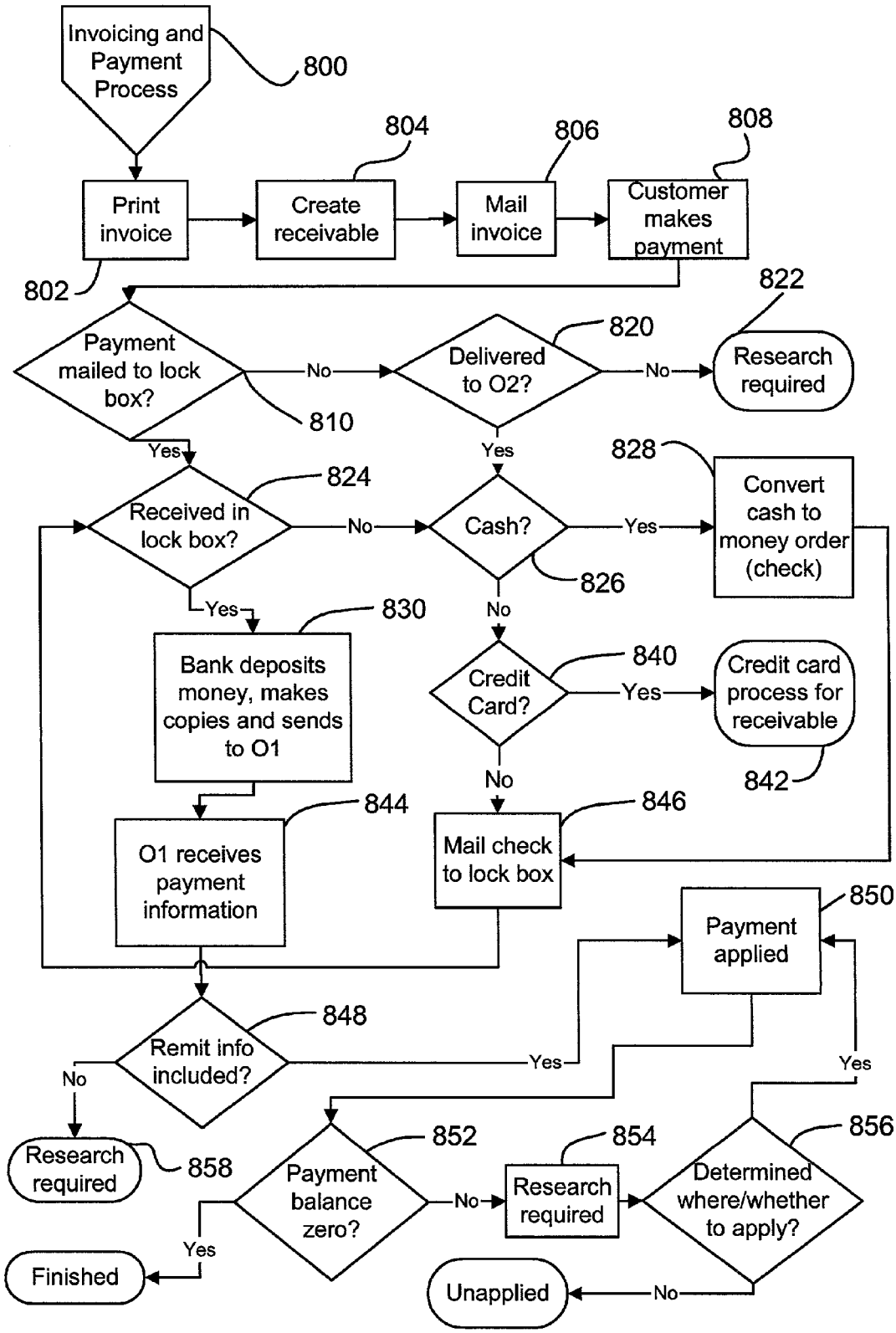
FIG. 9 is a schematic flowchart representing an invoicing and payment process of the program of FIG. 1.

Referring to FIG. 9, the invoicing and payment process 800 may be provided for notifying the customer of payment due for a product or service. The invoicing and payment process 800 may commence with the printing an invoice 802. The printed invoice may be generated by the first organization but is preferably generated by the second organization on behalf of the first organization. After printing the invoice 802, a receivable may be created 804. The invoice may be mailed 806 or otherwise delivered to the customer, after printing the invoice 802. (If the first organization is on an accrual basis accounting system revenue from the invoiced items is realized at the time the invoice is generated) The customer receives the invoice and makes payment 808. (If the first organization is on a cash basis accounting system, revenue from the invoiced items is realized at the time payment is received) Different actions are taken by the first and second organizations depending upon how payment is made. In general the customer may pay by cash, check or by credit/debit card. The payment is preferably delivered to the first organization's bank by check. In the exemplary embodiment of the process shown in FIG. 9, the customer is instructed to mail payment to the first organization's lock box. However the process also contemplates the possibility that the customer delivers the payment directly to the second organization. In this event the second organization forwards the payment to the bank. One payment event sequence is that payment is mailed 810 to a bank lock box 824. The lock box is an address and service provided by a financial institution such as a bank. When payment is made to the lock box, the bank deposits the money to the first organization's account, makes copies of the payment and sends the copies and a payment information to the first organization 830. The first organization receives the payment information 844 and decides if the needed remit information is included 848. The remit information is basic payment tracking information such as customer name, invoice number, etc. If the remit information is not included, then research is required 848. If remit information is included, then the payment is applied 850 to the customer's account receivable. After the payment is applied, 850, the payment balance is calculated 852. If the payment balance is zero, then the process is finished. If the payment balance is not zero 852, then research is required 854. After researching, the first organization determines where the payment should be applied, or if it should be applied at all, 856. Depending upon the determination, the payment is applied 850 or remains unapplied. The sequence of events that takes place when the customer makes payment to the second organization is shown commencing with 820. If the customer pays the second organization in cash, the second organization converts it to a check or money order 828 and sends it to the bank lock box 846. If the customer pays by check, the second organization mails the check to the lock box 826, 840, 846. If the customer pays by credit card, then the second organization applies the credit card payment directly to the first organization account.

Additional aspects of the program may include that the second organization will invoice customers directly on accounting software provided by the first organization. The second organization's staff working on customer billings and/ or assisting customers in resolving issues regarding their billings will follow all first organization pre-approved policies and procedures regarding invoicing, accounts receivable and working with customers.

In the event that payment of an invoice becomes delinquent, the collection process 900 may be initiated.

Collection Process

In the event there is a dispute between the second organization and a customer that the second organization is not able to resolve to the customer's satisfaction within some fixed period, e.g. one month, the second organization is required to inform the first organization of the dispute and all the particulars relating thereto. The second organization is required to keep reasonable records regarding the customer dispute, including customer contact, response, and actions taken to resolve the dispute. If the second organization has made more than a predetermined number of attempts, e.g. three, within one month to resolve the issue, the second organization is also required to inform the first organization of the dispute and all the particulars relating thereto. After learning of the dispute, the first organization is responsible for handling the matter. Having described the collection process generally, one specific implementation will now be described with reference to FIG. 10.

Figure 10:
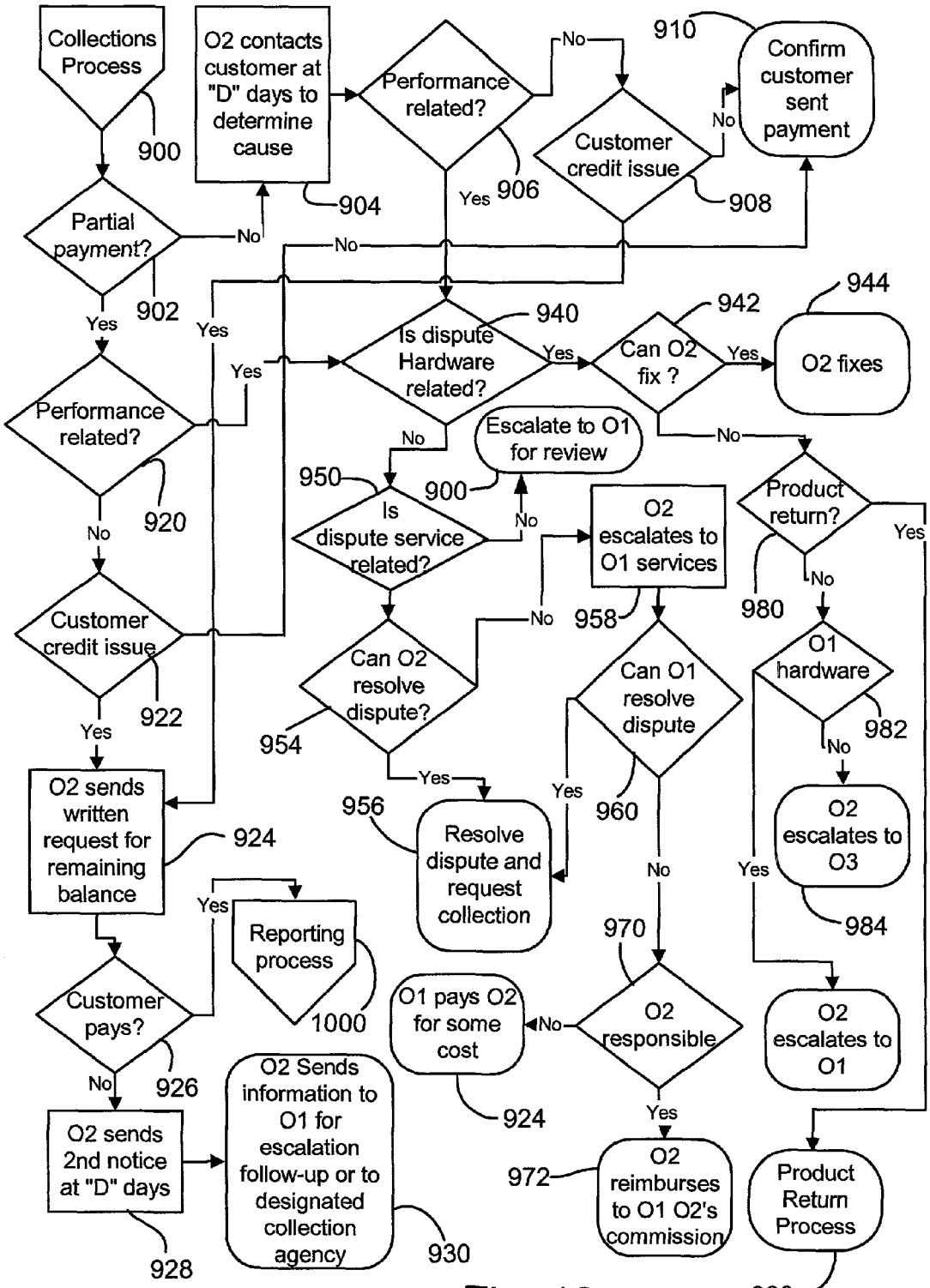
FIG. 10 is a schematic flowchart representing a collection process of the program of FIG. 1.

Referring to FIG. 10, a collection process 900 may be provided for collecting unpaid or insufficiently paid bills for services and/or products sold by the second organization. The collection process 900 commences if only a partial payment or no payment was made by the customer by a payment due date 902. In the event that even a partial payment was not paid the second organization contacts customer at "D" days to determine the cause of nonpayment 904. The second organization inquiries as to whether or not the issue was performance related 906. If the issue for non-payment is not performance related, then a further inquiry is made to determine if there is a customer credit issue 908, i.e. to determine whether the customer had actually failed to pay or if the payment was merely in transit or not properly delivered, etc., but had actually been made. If the purported non-payment was in fact an error, then it will be confirmed that the customer sent payment 910.

In the event that a partial payment 902 was made, then the second organization contacts the customer to determine if the reason for mailing only partial payment is performance related 920. If the reason is not performance related 920, then a customer credit issue 922 arises and a determination is made as to whether full payment had in fact been made but for some reason not credited 922. If it is determined that less than full payment had not been made for any reason except performance issues, then the second organization sends a written request for the remaining balance 924. After the second organization sends written request for the remaining balance 924, if the customer does not make payment 926, the second organization may send a second notice after "D" days 928. After sending the second notice at "D" days 928, the second organization sends the information to the first organization for follow-up or for forwarding to a designated collection agency 930. In the event that the outcome of the customer payment 926 decision is positive, the second organization reporting process 1000 may commence.

Referring back to the performance related 920 decision 906 and 920. If the outcome of a performance related 906, 920 decision is positive, then an inquiry is made to determine if the dispute is hardware related 940. In the event that the reason for partial-payment or non-payment is hardware related, then the second organization decides whether it has the ability to fix the hardware, 942. If it is determined that the second organization can fix the hardware, it fixes the hardware, 944.

Referring back to the "dispute hardware related" 940 decision. If the dispute for partial-payment or non-payment is not hardware related then a decision is made as to whether the dispute is service related 950. If it is not, then the issue will escalate to the first organization for review 952. If the dispute is service related, it is determined whether the second organization can resolve the dispute 954. If the second organization can resolve the dispute 954, it does and then requests collection, 956. If the second organization cannot resolve the dispute, the second organization escalates the issue to the first organization 958. The first organization may then determine if it can resolve the dispute, 960. If the first organization can resolve the dispute it does and requests collection, 956. In the event that the first organization cannot resolve the dispute, 960, then a determination of the responsibility is made 970. If it is determined that the second organization is responsible for the problem, then the second organization reimburses its commission to the first organization 972. In the event that the second organization is not responsible for the service dispute, then the first organization pays to the second organization for some cost incurred by the second organization going through the subject collection process 974.

Referring back to the "can second organization fix" 942 decision, if the outcome is negative then a product return 980 decision is made. If the product can be returned it is returned 990. If the product cannot be returned and it is not first organization hardware 982, then the second organization escalates the issue to the third organization who provided the hardware 984. If it is the first organization's hardware, then the second organization escalates to the first organization 986.

Regarding the collection process 900 in general, the first organization may set standard credit and collection guidelines which it may contractually require the second organization to follow. The first organization will inform the second organization of collections issues, thereby allowing the second organization a specified amount of time to work with their customers prior to first organization sending the debt to collectors.

Reporting Process

A reporting process 1000 is provided to accurately account for products and services sold through the program. The reporting process 1000 may commence with three parallel tasks. The first of the three parallel tasks may be for the second organization to send monthly invoices, returns, inventory, accounts receivable (A/R) and financial statements (F/S) to the first organization 1010. The second of the three parallel tasks may be for the third organization (a supplier of third organization products) to send a shipment and returns report to the first organization 1020. The third of the three parallel tasks may be for the first organization store to send a shipment and returns report to the first organization 1030. Upon completing the three parallel tasks, a first organization report verification process 1040 may be initiated to check the accuracy of the reports. After performing the first organization report verification 1040 process, the completeness of the statements and reports may be evaluated in a "reports complete" 1042 decision. If the one or more statements and reports are not complete, the organization responsible for the incomplete report or statement is contacted by the first organization, 1044, and required to provide a complete statement or report.

Referring back to the "reports complete" 1042 decision, once the reports and statements are complete, then these documents are further processed as indicated by the two branches of the flowchart. The two branches are a second organization reporting process 1048 and a third organization reporting process 1060. During the second organization reporting process 1048, the first organization reviews the second organization's financial reports, 1050. After the first organization reviews the second organization's financial reports 1050, and if no issues are noted 1052, then the second organization commission process 1100 may proceed. However if an issue is noted, then the first organization contacts the second organization to resolve the issue. If the issue is resolved 1056, then the second organization commission process 1100 may proceed. If the issue is not resolved at this stage, then the issue is escalated within the first organization for further review, 1058, for example it may be escalated to a review board within the first organization or to upper level managers or to corporate officers for a decision.

Referring new to the "third organization reporting process" 1060, the third organization(s) is an independent distributor(s) and/or manufacture(s) of products that are not available by from the first organization. The first organization initially reconciles the third organization shipments 1062. If there is not an amount to reconcile, 1064, then the first organization sends payment to the third organization 1068. If there is an amount to reconcile, then a review with the second organization is conducted to resolve the discrepancy, 1066. After resolving the discrepancy 1066, the first organization sends payment to the third organization.

Various ancillary provisions may be provided with the reporting process 1000. These ancillary provisions may include actual tasks to be completed by one of the organizations, or may be inherent and/or imbedded actions of the process. For example, the second organization may be required to deliver the reports at times specified by first organization to the first organization. The second organization may be asked to prepare and submit draft reports and final reports to first organization on the operation of the program and the services provided. For service performed by the second organization, it may be required that reports include a description of analytical methods and quality assurance procedures employed in rendering the service. The second organization may also be required to provide the first organization with a copy of the text of any report in electronic format upon request.

Second Organization Commission Process

Figure 12:
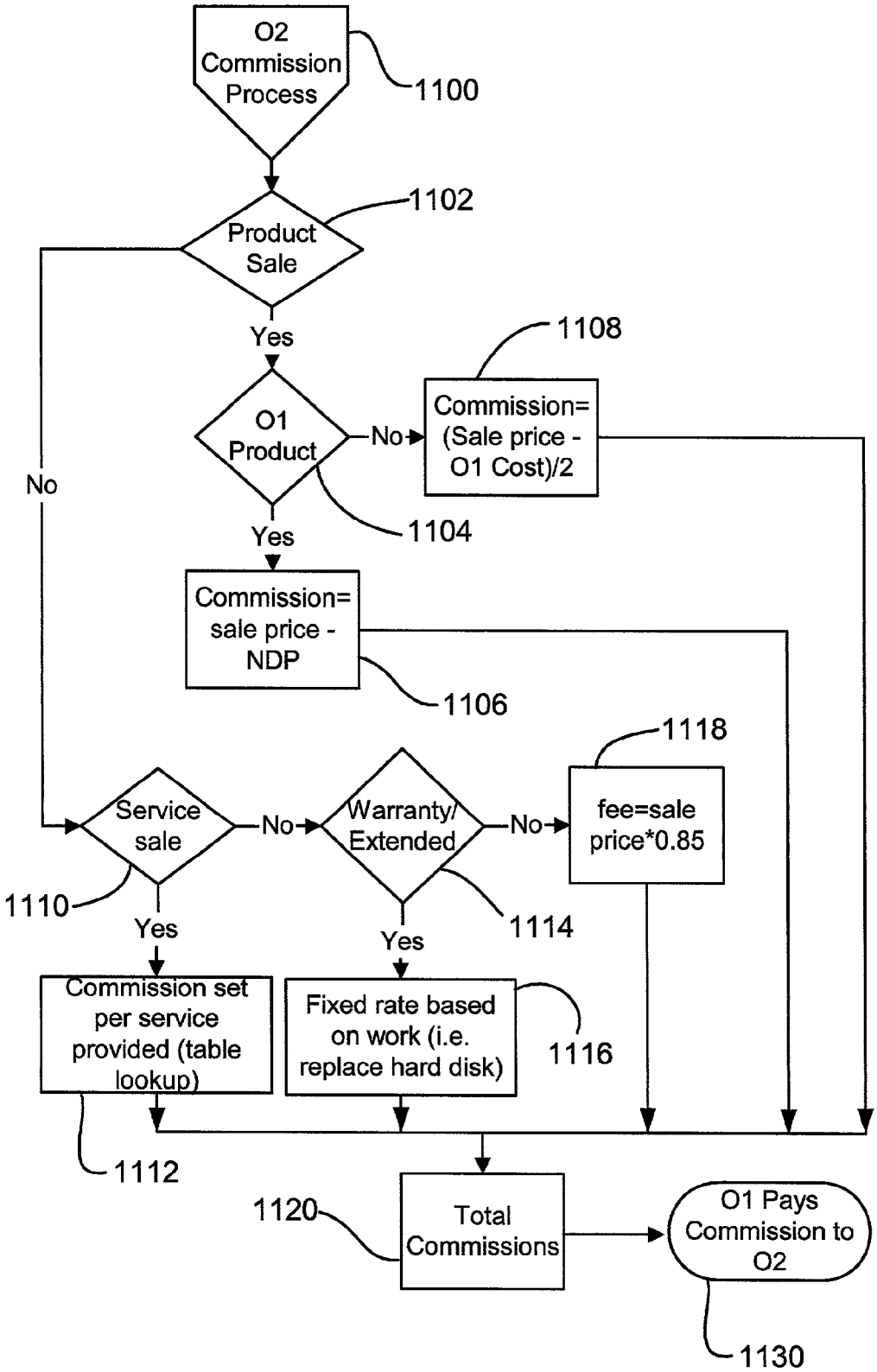
FIG. 12 is a schematic flowchart representing an second organization commission process of the program of FIG. 1.

Referring to FIG. 12, the second organization commission process 1100 may commence with a product sale 1102 decision. If the sale was a product, it is next determined 1104 if the product was a first organization product. In the event that the sale was a first organization product, then a commission is calculated according to a preset formula, e.g. the commission is equal to the sale price less net dealer price (NDP), 1106. Referring back to the first organization product 1104 decision, if it is not a first organization product, then a commission according to another formula is calculated, e.g. the commission equals the quantity sale price less the first organization multiplied by 0.9, 1108. Referring back to the product sale 1102 decision, if the sale was not a product, then it is determined if a service sale 1110 was made. If the sale was a service sale, then a commission is determined according to another formula or table, e.g. the commission may be set per the particular item (table lookup), 1112. Referring back to the service sale 1110 decision, if the sale was not a regular service but rather a warranty/extended service sale 1114, then a commission is calculated for that work. The commission may be a fixed rate based on the work task, 1116. For other types of work the commission may be based on the actual service charge, e.g. the commission equals service sales amount times 85%, 1118. Upon completing of the individual commission calculations 1108, 1112, 1116 and 1118, a total commissions, 1120, is calculated. After determining the total commissions 1120, the first organization pays the total commission to the second organization 1130.

Exemplary Application of the Program

Having provided a detailed description of the individual processes of the program, an exemplary application thereof will be provided herein. It is noted that this exemplary application is further directed to computer hardware and ancillary services. However, again, the program is also applicable to other types of products and associated services such as, for example, trucks, automobiles, boats, planes, construction supplies, industrial machinery, institutional products such as food, maintenance equipment and athletic equipment, telecommunication equipment, office furniture, etc.

In an exemplary application a small business customer having 200 employees desires to have a network of computers installed at its location. The customer received advertising from the first organization highlighting the first organization's timely installation, thorough attention to detail and ability to perform most computer installations. Upon receiving the advertising, the customer contacted the number provided in the advertisement to obtain more information. The ensuing hypothetical description of this customer's interaction with the first organization, second organization and third organization will now be described.

A flowchart of the program 100 is shown in FIG. 1, wherein the program is composed of a plurality of processes.

Prior to interacting with the customer, an applicant approached the first organization to inquire about entering the program as a second organization. Referring still to FIG. 1, the second organization qualifying process 200 is provided for qualifying the applicant to determine if the organization is capable of entering the program. Referring to FIG. 2, the applicant submits an application packet 210 to the first organization. A plurality of topics will be examined by the first organization to predict the applicants potential for successful performance in the program. In this exemplary scenario, the applicant has a three-year business plan, therefore the outcome to the does applicant have a two-year business plan 212 decision is positive. Therefore, the percentage of applicant's customers that is in a target market 214 decision is provided and compared against a predetermined percentage. The applicant has a relatively high number of SMB customers and therefore the outcome is positive. Additionally, assuming that the applicant has a high number of support to sales people, a positive outcome of the applicant has a support to sales ratio of "S:S" 216 decision is obtained. With a positive outcome of the 216 decision, the annual sales greater than a predetermined amount 218 decision may be provided. Assuming that the annual sales for the applicant are relatively high, the outcome of the 218 decision is positive. With a positive outcome of the 218 decision, the sales of first organization products greater than "P" % of gross sales 220 decision may be provided. Assuming that the sales of first organization products accounts for a relatively high percentage of the gross revenues of the applicant, the outcome is positive. With positive outcomes to the various decision evaluated during the second organization qualification process 200, the applicant is accepted as a second organization into the program 224.

Upon accepting the applicant, the establish second organization process 300 may be initiated.

Referring to FIG. 3, the establishing second organization process 300 is a process for introducing the second organization to the program. A variety of processes may be provided, in this exemplary embodiment the get corollary material produced 310 process is implemented in which the first organization provides the second organization with business cards, stationary and coffee cups bearing the insignia of the first organization. Additionally the initiate advertising campaign 312 process may be commenced as by a television and newspaper advertisements touting the relationship between the first and second organizations. An open-house event 314 may be held at the second organization facility at which first organization personal demonstrate products, etc. The first organization may help notify existing customer base 316 of the second organization of the new relationship. After establishing the second organization by completing the various processes, the demand generation process 400 may be undertaken.

Referring to FIG. 4, various steps may be taken to generate demand for the first organization's products. This demand may be created before or after the first organization and second organization enter in to a relationship but is performed with the intention that a second organization will become available to service the created demand. Various marketing initiatives may be performed by the first organization to generate inquiries from potential customers. The various demand generation programs may include direct marketing mailings 410, hosting information seminars 420 and advertising campaigns 430. A follow-up demand generation evaluation 440 may be implemented to determine which of these processes to continue and which to drop.

The customer begins its relationship with the first and second organizations by undergoing a customer credit approval process 500. Referring to FIG. 5, the customer, for example, may ask to purchase a computer network on credit 510. The customer is provided a credit application that is subsequently filled out 512. The credit application is reviewed by the second organization 514 and determined to be complete or not 516. Assuming that the application is complete and that the customer is requesting a high credit limit, the credit application is sent by the second organization to the first organization 520. The first organization requests further credit information from the customer and assess the risk 522. Assuming that the first organization approves the credit during the approval decision 524, the first organization informs the second organization of the approval 526. After being notified of the credit approval, the second organization notifies the customer of the credit approval amount 536. After notifying the customer of the credit amount 536, the sales order management process 600 may commence.

Referring to FIG. 6, during the sales order management process 600, the pre-approved customer having made an inquiry regarding a proposed purchase has that proposed purchase reviewed by the second organization. The second organization determines the approximate sales value of the proposed purchase, say for a computer network for $40,000 during the review customer inquiry and estimate value 611. Next, in the room in credit limit 612 decision the second organization compares this $40,000 estimate to the customer approved credit. Assuming that the customer approved credit is more than $40,000, a sales meeting 614 takes place between the second organization and the customer. During the sales meeting the second organization determines what exact products and services the customer requires for its computer network. After the sales meeting 614 the second organization prepares a bid 616 and submits the bid to the customer, say $39,500 for all the network products and software with setup and one year support. Assuming that the bid is accepted during the bid accepted 618 decision, the order fulfillment process 700 may commence.

Referring to FIG. 7, during the order fulfillment process 700 the customer's order may be routed through an order system. Assuming that the order does not contain any third organization products, the outcome of the does order include third organization product 732 decision is negative. Further assuming that the order contains first organization products such as computers, printers and networking hardware, the outcome of the does order include first organization product 734 decision is positive. With a positive outcome, the second organization places the order on the first organization system for the first organization products 736. The order is sent to the first organization store 738 where the order exceeds second organization credit limit 740 decision is provided. Assuming that the order does not exceed the second organization's credit limit, the outcome of the decision 740 is negative. With a negative outcome of the decision 740, the first organization store processes the order 744 and ships the product to the customer address 746. Upon shipment of the first organization product 746, the invoicing and payment process is provided 800. In some situations the order may be invoiced prior to shipment.

Referring to FIG. 8, the order fulfillment process 700 is further provided with a services order fulfillment process 770. In the exemplary description provided herein the computer network requires consulting services. The outcome of the services purchased 772 decision is positive and since the services are not completed, the outcome of the services completed 774 decision is negative. The particular services in this exemplary scenario do not include support, therefore the outcome of the services include support 776 decision is negative. Assuming that the services will be completed within 1 month, the outcome of the services completed within one month 778 decision is positive. The services are then competed 788. It may be verified that the services are complete in the services complete 790 decision. After verifying that the services are complete, the invoicing and payment process 800 is provided.

Referring to FIG. 9, the invoicing and payment process 800 is provided to notify the customer that payment is required and the process by which the payment is routed and accounted. In the exemplary scenario, an invoice is generated and printed 802 by the second organization on the first organization's behalf. A receivable is created 804 at this time for internal accounting procedures. The invoice is then mailed to the customer 806. After receiving the invoice, the customer may pay the bill for the equipment and services provided 808 in various ways. The payment may be mailed by the customer to a lock box managed by a financial institution on the first organization's behalf. Assuming that the payment was mailed and received in the lock box, the outcome of the received in lock box 824 decision is positive. In this case, the bank deposits the money directly with the first organization, makes copies of the transaction and sends the information to the first organization 830. The first organization receives the payment information 844 and the checks to see if the remit information is included 848. Remit information in the present example is a copy of the original invoice, for example. If the remit information is included the outcome of the remit information included 848 decision is positive and the payment is applied 850 against the customer's credit denoting the account receivable generated in process 804. If the payment results in a zero balance for the customer, the outcome of the payment balance is zero 852 decision is positive and the invoicing and payment process 800 is complete.

In the exemplary scenario described herein, the customer made full payment for the invoice during the invoicing and payment process 800 (FIG. 9). Therefore, the collection process 900 (FIG. 10) is not required. In the event that a payment is not provided or is insufficient, the collection process 900 would be initiated.

Figure 11:
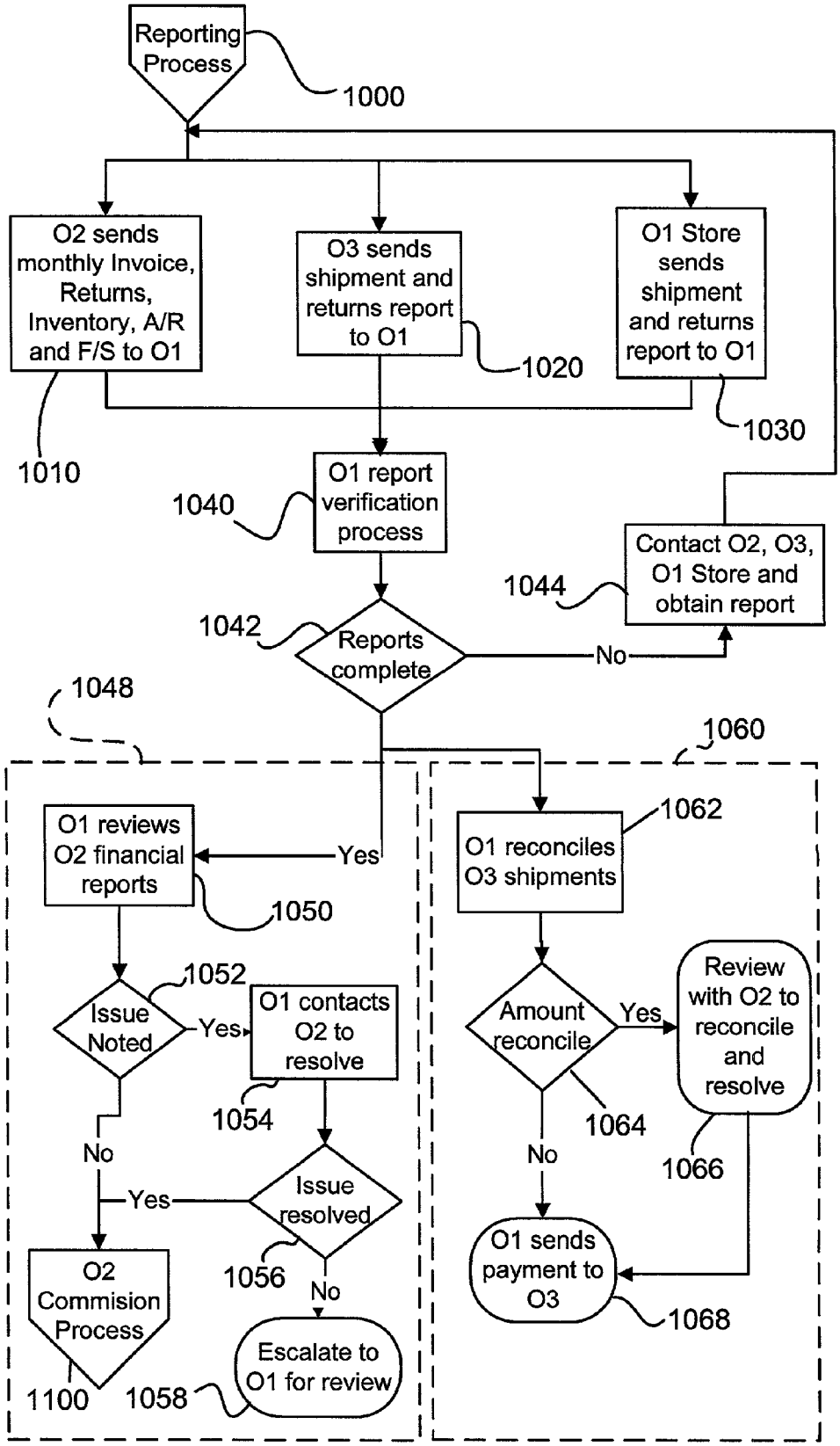
FIG. 11 is a schematic flowchart representing an second organization reporting process of the program of FIG. 1.

Referring to FIG. 11, the reporting process 1000 is provided in this exemplary scenario for paying third organization(s) and collating information for use in the second organization commission process 1100. With the present example, the second organization sends monthly invoices, returns, inventory, accounts receivable and financial statements to the first organization 1010 and the first organization store sends shipment and returns reports to the first organization 1030. The first organization then verifies the information 1040 and checks to see that all reports are complete 1042. The first organization further reviews the second organization financial reports 1050 and checks to see if any issues are noted 1052. In the event that no issues are noted, the outcome of the issue noted 1052 decision is negative and the second organization commission process 1100 may be initiated.

Referring to FIG. 12, the second organization commission process 1100 is provided for compensating the second organization. In this exemplary application, the product sold was a computer network with some consulting services. Since a product and service were sold, the commission process will be applied twice, once to the product sale and once to the service sale. The sale was for a product (the computer network hardware), therefore the outcome to the product sale 1102 decision is positive. After a positive outcome of the product sale 1102 decision, the first organization product 1104 decision determines the commission rate. In this exemplary scenario, the products were first organization products, therefore the outcome of the first organization products 1104 decision is positive and the commission is equal to the sale price less net distributor price 1106. (The net distributor price is the price charged by the first organization store for the computer network products. This commission is the amount that will be paid directly from the first organization to the second organization. Since this exemplary scenario also had service sales, when revisiting the second organization commission process 1100, the outcome of the product sale 1102 decision is also negative. Therefore, the service sale 1110 decision is implemented. Since the service was consulting on the computer network, the outcome of the service 1110 decision is positive and the commission is set based on the service provided 1112. In this exemplary scenario, the commission obtained through a table lookup results in ninety percent of the sale price being paid to the second organization while ten percent is retained by the first organization. Upon completing all of the individual commission calculations, the commissions are totaled 1120 and the first organization pays the commission to the second organization 1130. In an exemplary embodiment, commission payments are calculated and sent to the second organization(s) at regular payment periods, e.g. monthly.

Advantages of Program

This program, in general, enables a first organization to tightly monitor and control a second organization with which it does business. This program is structured to allow the first organization to report the sale price paid by the customer as the first organization's revenue. Additionally, the program allows the second organization to act as an extension of the first organization.

This model allows the first organization to have a direct relationship with a customer helping it to closely monitor customer satisfaction with its products and to generate brand loyalty. The small-to-medium sized business has a large, reputable first organization standing behind its purchased products while receiving local personal support from a small, trusted second organization. From the second organization's perspective, this model leverages the core competencies of both the first organization (brand name, full line of quality products, demand generation expertise, ability to centralize credit and collections) and the second organization (local presence, ability to create complete solutions beyond just first organization hardware, customer relationships, service revenue) to create a compelling customer experience. This program allows the first organization to take the top-line revenue and to centralize the costs of marketing, credit and collections, and startup investments, while the second organization has the ability to expanded its available market with first organization demand generation while enhancing its profitability by entirely avoiding credit and collections activities. The second organization thus has the opportunity to expand into new geographies with its freed-up cash and time resources.

The first organization under this program can recognize revenue from small/medium businesses (traditionally a difficult market for large organizations) through partnerships with a second organization(s) with a large portion of its revenue coming in the form of services. This type of revenue sharing creates a very tight partnership between the two organizations with a common goal of creating an excellent customer experience while increasing revenue in and share of the SMB market.

Customers have one place to go for all their needs, with a single invoice and local support provider. The financial model creates a profitable way for first organization to increase market share.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

We claim:

1. A computer-implemented method for a first organization to do business comprising:

entering, by a computer system, into a contractual relationship with a second organization;

authorizing, by said computer system, said second organization to take an order from a customer, said order comprising at least one of:

products not produced by said first organization, and services not provided by said first organization;

receiving, by said computer system, payment directly from said customer as a payment for said order taken by said second organization;

requiring, by said computer system, an organization other than said first organization to ship products not produced by said first organization to said customer;

requiring, by said computer system, an organization other than said first organization to provide services to said customer;

determining, by said computer system, a billing strategy based upon whether or not the services ordered may be completed in less than a predetermined period of time;

wherein it is determined, by said computer system, that the services ordered may not be completed in less than the predetermined period of time and further comprising determining, by said computer system, whether the services ordered are essential to the use of hardware included on the order; and wherein it is determined, by said computer system, that the services ordered are not essential to the use of hardware included on the order and further comprising invoicing the hardware portion of the order prior to completion of the services ordered.

2. The computer-implemented method of claim 1 and further comprising:

requiring said second organization to provide a second organization service to a customer.

3. The computer-implemented method of claim 1 and further comprising:

requiring a third organization to provide a third organization service to said customer.

4. The computer-implemented method of claim 3 and further comprising:

verifying that said third organization service was performed by said third organization.

5. The computer-implemented method of claim 1 and further comprising:

requiring a third organization to ship a third organization product to said customer.

6. The computer-implemented method of claim 5 wherein said requiring a third organization to ship comprises requiring said third organization to ship said third organization product from a facility not controlled by said first organization.

7. The computer-implemented method of claim 5 and further comprising:

verifying that said third organization product was received by said customer.

8. The computer-implemented method of claim 5 and further comprising:

paying said third organization for said third organization product.

9. The computer-implemented method of claim 8 and further comprising:

tracking said paying said third organization by computer.

10. The computer-implemented method of claim 1 and further comprising:

tracking receipt of said payment by computer.

11. The computer-implemented method of claim 1 and further comprising:

paying said second organization a predetermined amount based on said order.

12. The computer-implemented method of claim 11 and further comprising:

tracking said paying said second organization by computer.

13. A computer-implemented method for a first organization to do business comprising:

requiring, by a computer system, a second organization to take an order for sales items on behalf of the first organization;

in response to a determination, by said computer system, that the order includes a product distributed by a third organization sending an order for that product to the third organization;

requiring, by said computer system, the third organization to ship the product directly to a customer's address;

requiring, by said computer system, the third organization to notify the second organization when the product has been shipped;

wherein the product shipped by the third organization is less than all items distributed by the third organization that were on the order;

requiring, by said computer system, the third organization to notify the second organization when the order is incomplete and when the backlog for items on the order that were not shipped is longer than a predetermined number of days;

determining, by said computer system, a billing strategy based upon whether or not the services ordered may be completed in less than a predetermined period of time;

wherein it is determined, by said computer system, that the services ordered may not be completed in less than the predetermined period of time and further comprising determining, by said computer system, whether the services ordered are essential to the use of hardware included on the order; and wherein it is determined, by said computer system, that the services ordered are not essential to the use of hardware included on the order and further comprising invoicing the hardware portion of the order prior to completion of the services ordered.

14. The computer-implemented method of claim 13 further comprising:

invoicing the customer after the third organization notifies the second organization that the product has been shipped.

15. The computer-implemented method of claim 13 further comprising:

requiring the second organization to notify the first organization when the order is incomplete and when the backlog for items on the order that were not shipped is longer than a predetermined number of days.

16. A computer-implemented method for a first organization to do business comprising:

requiring, by a computer system, a second organization to take an order for sales items on behalf of the first organization;

in response to a determination, by said computer system, that the order includes a product distributed by a third organization sending an order for that product to the third organization;

requiring, by said computer system, the third organization to notify the first organization when the order exceeds a predetermined credit limit of the second organization;

determining, by said computer system, a billing strategy based upon whether or not the services ordered may be completed in less than a predetermined period of time;

wherein it is determined, by said computer system, that the services ordered may not be completed in less than the predetermined period of time and further comprising determining, by said computer system, whether the services ordered are essential to the use of hardware included on the order; and wherein it is determined, by said computer system, that the services ordered are not essential to the use of hardware included on the order and further comprising invoicing the hardware portion of the order prior to completion of the services ordered.

17. A computer-implemented method for a first organization to do business comprising:

in response to a determination, by a computer system, that services in a service order taken by a second organization on behalf of the first organization is incomplete determining whether the service order includes support services;

determining, by said computer system, a billing strategy based upon whether or not the service order includes support services;

in response to a determination, by said computer system, that the service order does not include support services determining whether the services ordered may be completed in less than a predetermined period of time;

determining, by said computer system, a billing strategy based upon whether or not the services ordered may be completed in less than a predetermined period of time;

wherein it is determined, by said computer system, that the services ordered may not be completed in less than the predetermined period of time and further comprising determining, by said computer system, whether the services ordered are essential to the use of hardware included on the order; and wherein it is determined, by said computer system, that the services ordered are not essential to the use of hardware included on the order and further comprising invoicing the hardware portion of the order prior to completion of the services ordered.

* * * * *